United States Patent [19]

Wiesinger et al.

[11] 4,294,307

[45] Oct. 13, 1981

[54] SUPPORTING AND GUIDING STAND ARRANGEMENT TO BE USED IN A BOW-TYPE CONTINUOUS CASTING PLANT

[75] Inventors: Horst Wiesinger; Werner Scheurecker, both of Linz, Austria

[73] Assignee: Voest-Alpine Aktiengesellschaft, Linz, Austria

[21] Appl. No.: 118,657

[22] Filed: Feb. 4, 1980

[30] Foreign Application Priority Data

Mar. 8, 1979 [AT] Austria ..... 1762/79

[51] Int. Cl.[3] ..... B22D 11/128

[52] U.S. Cl. ..... 164/448; 414/498

[58] Field of Search ..... 164/441, 442, 447, 448; 104/106-108; 9/1.2; 414/498, 546, 549

[56] References Cited

U.S. PATENT DOCUMENTS 3,763,923 10/1973 Gallucci ..... 164/448
4,212,580 7/1980 Fluck ..... 9/1.2 X
4,223,715 9/1980 Streubel ..... 164/448 X

FOREIGN PATENT DOCUMENTS 1239440 4/1967 Fed. Rep. of Germany .
1285095 12/1968 Fed. Rep. of Germany ..... 164/448
1920757 11/1970 Fed. Rep. of Germany .
2053755 5/1972 Fed. Rep. of Germany .
378050 7/1975 U.S.S.R. ..... 164/448

*Primary Examiner*—Robert D. Baldwin
*Attorney, Agent, or Firm*—Brumbaugh, Graves, Donohue & Raymond

[57] ABSTRACT

A supporting and guiding stand for a bow-type continuous casting plant comprises exchangeable supporting segments supported on a carrying frame, in which segments the rollers of the oppositely arranged inner and outer guideways are mounted at a distance from one another. In the center of the circular arc along which the supporting segments are arranged, a pivoting lever including a device for seizing and extracting individual supporting segments is mounted. The length of the lever is shorter than the radial distance from the center to the supporting segments. For removing a desired supporting segment, telescopically extendable and retractable guide rails are provided on the pivoting lever, which, after having been moved out into the strand guideway, seize a supporting segment in a fork-like manner. Upon seizure counter guides arranged on the supporting segment come into engagement with the guide rails, the supporting segment thus being removable from the installed position along the guide rails.

7 Claims, 6 Drawing Figures

SUPPORTING AND GUIDING STAND ARRANGEMENT TO BE USED IN A BOW-TYPE CONTINUOUS CASTING PLANT

BACKGROUND OF THE INVENTION

The invention relates to a supporting and guiding stand for a bow-type continuous casting plant, comprising exchangeable supporting segments supported on a carrying frame, in which segments the rollers of the oppositely arranged inner and outer guideways are mounted at a distance from one another. In the center of the circular arc along which the supporting segments are arranged a pivoting lever, including means for seizing and extracting individual supporting segments, is mounted. The length of the lever is shorter than the radial distance from the center to the supporting segments.

Exchange arrangements for supporting segments of strand guides and including a pivoting lever have already been known and described, for instance in German Pat. No. 1,285,095. With this known construction, a car is displaceably arranged in the pivoting lever for engaging the guiding segment from below and which, after having been moved out into the strand guideway, is connected with the segment to be moved out so as to carry the segment with it.

SUMMARY OF THE INVENTION

The invention has as its object to provide an improved exchange arrangement which is less complex in its construction, without a separate car being necessary for accommodating a supporting segment, and with which it is guaranteed that the segment seized is safely held and guided during the removal. The arrangement is also utilizable for segments of a heavier design.

This object is achieved according to the invention with a supporting and guiding stand of the initially-defined kind in that telescopically retractable and extendable guide rails are provided on the pivoting lever, which, after having been pushed out into the strand guideway, seize a supporting segment in a fork-like manner. Counter guides fastened to the supporting segment come into engagement with the guide rails and the supporting segment is then removable from the installed position along the guide rails.

Advantageously, the counter guides at the supporting segment are designed as wheels or rollers.

Suitably, the pivoting lever and the guide rails are designed with C-shaped profiles and, in the retracted position, recesses are provided in the pivoting lever and in the guide rails for letting the counter guides pass through the rails during removal of the segment from the rails after it has been withdrawn from the carrying frame.

According to a preferred embodiment, a rope winch for extracting the segment and an adjustment drive for the moving in and out of the guide rails, are arranged in the center of the circular arc.

Preferably, a hydraulic drive, which can be moved together with the pivoting lever, is provided for the moving in and out of the guide rails.

A further object on which the invention is based involves making possible an exchange of the supporting segments without jamming, even if the distances of the axes of neighbouring rollers are very small.

This object is achieved in that to each supporting segment at least one rim-side roller of the outer guideway is fastened to a carrier which is detachably fastened to the segment. During the removal of the segment, the carrier together with the roller is placeable into a recess on the carrying frame.

By this means it is possible to arrange the rollers at a very small distance from one another, without a collision with one of the neighbouring segments occurring when removing a segment.

BRIEF DESCRIPTION OF THE DRAWINGS

The invention will now be explained in more detail by way of two embodiments and with reference to the accompanying drawings which are in schematic illustration, wherein.

DESCRIPTION OF EXEMPLARY EMBODIMENTS

Figure 1:
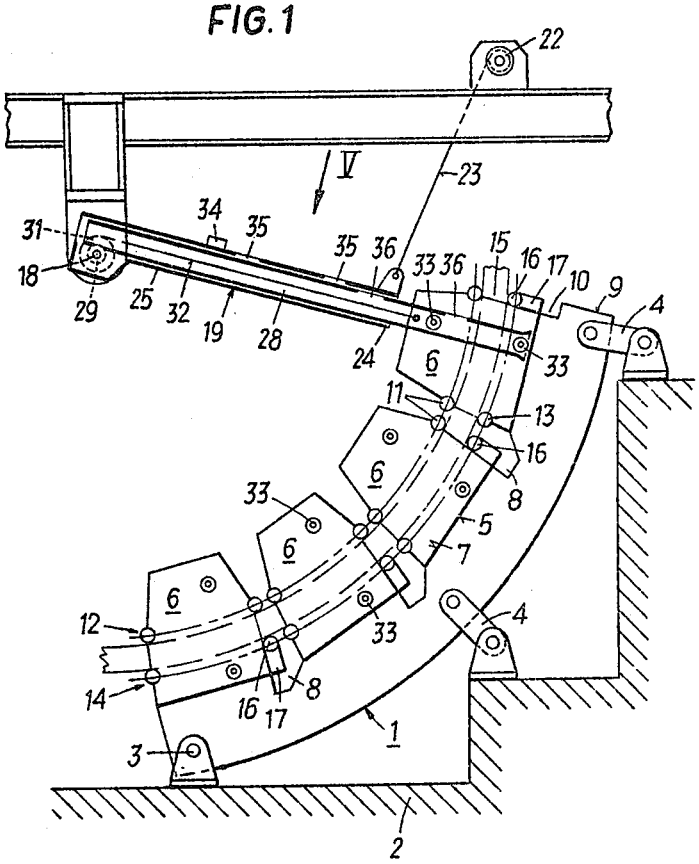
FIGS. 1 to 4 are each a side view (partly sectioned) of a guiding arc according to one embodiment.
Figure 5:
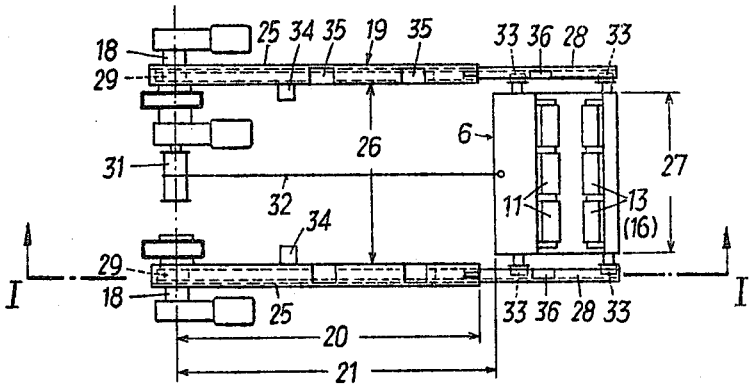
FIG. 5 represents a view in the direction of the arrow V of FIG. 1.

On a one-piece circular-arc-shaped carrying frame 1, which is mounted on a base 2 by means of a fixed bearing 3 and two expansion bearings 4, supporting faces 5 that are machined towards the inside of the arc are provided. One segment 6 is supported on each such face. The carrying frame 1 could also be designed in several parts, each of the parts being supported against the base by means of a fixed bearing and an expansion bearing. The segments 6 possess machined counter faces 7 mating with the supporting faces 5, so that the installation of the individual segments 6, in case of an exchange, is easily feasible without requiring fitting operations. Between the supporting faces 5 of each segment there is a pocket 8 of approximately trapezoidal cross section. At the upper end 9 of the carrying frame 1, on which the uppermost segment is arranged, there is also provided a pocket 10 having a rectangular cross section.

In the segments 6, which advantageously are designed so as to be equal to one another, the rollers 11 of the inner guideway 12 and the rollers 13 of the outer guideway 14 are oppositely arranged at a distance from one another, each rim-side first roller 16 of the outer way 14 is detachably fastened to the segment 6 in such a manner that its bearings are arranged on a cross carrier 17, which in turn is detachably fastened to the segment 6.

Figure 6:
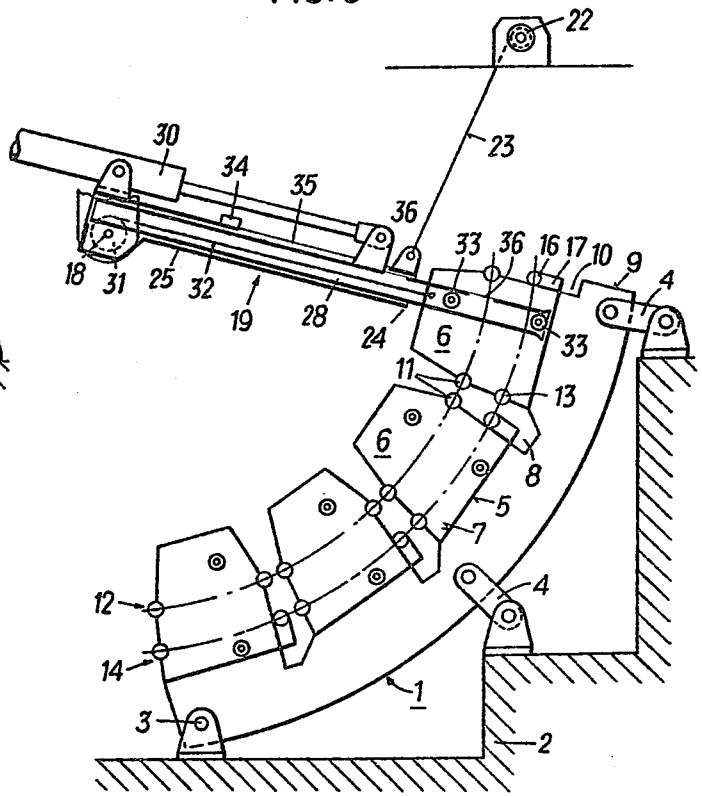
FIG. 6 illustrates another embodiment in an illustration analogous to FIG. 1.

In the center 18 of the circular-arc-shaped guideways 12, 14, a lever 19 is pivotably mounted. The length 20 of the lever is shorter than the radial distance 21 from the center 18 to the supporting segments 6. For pivoting a stationarily arranged rope drive 22 serves, the rope 23 of which is fastened to the end 24 of the pivoting lever 19. The pivoting lever 19 comprises two members 25 with C-shaped profiles, which members are arranged at a distance 26 from each other, wherein the distance 26 is slightly larger than the width 27 of the supporting segment 6. In these C-shaped members 25 there are provided guide rails 28 also designed with C-shaped profiles and which can be moved in and out. For moving these guide rails in and out, a drivable pinion 29, which is rotatably arranged at the center 18, is provided for each rail, which pinion engages in a toothed rack arranged on the lower side of the C-shaped guide rails. Instead of the pinion and the toothed rack, it is also possible to provide a pressure medium cylinder 30, as is illustrated in FIG. 6. In the center 18, furthermore, a rope winch 31 is rotatably mounted. The rope 32 of the winch is fastenable to the segment 6 to be removed.

Figure 3:
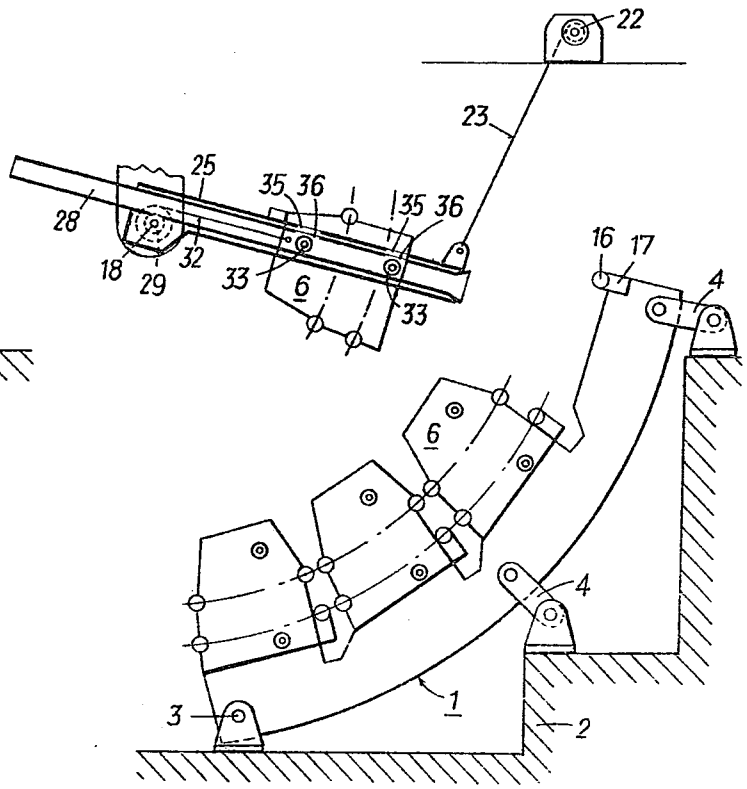
Figure 2:
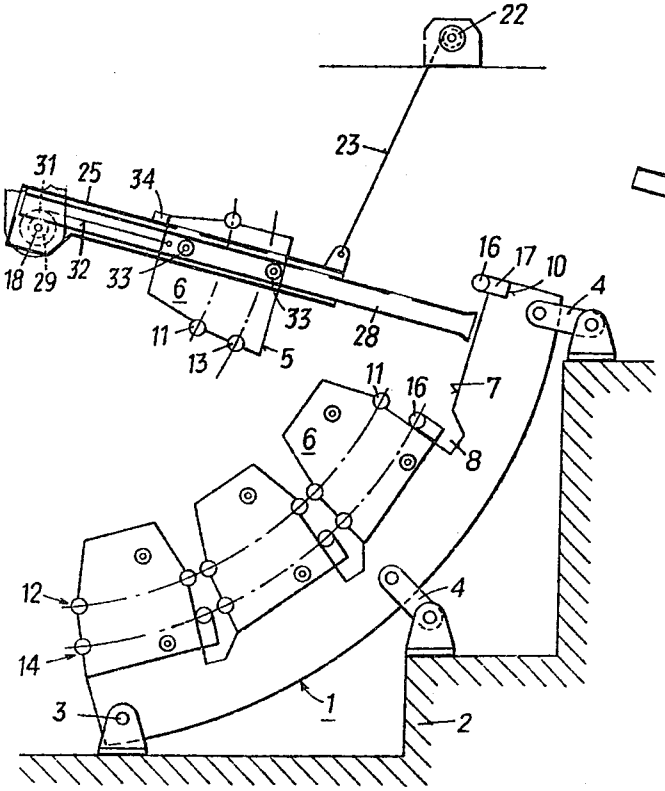
Figure 4:
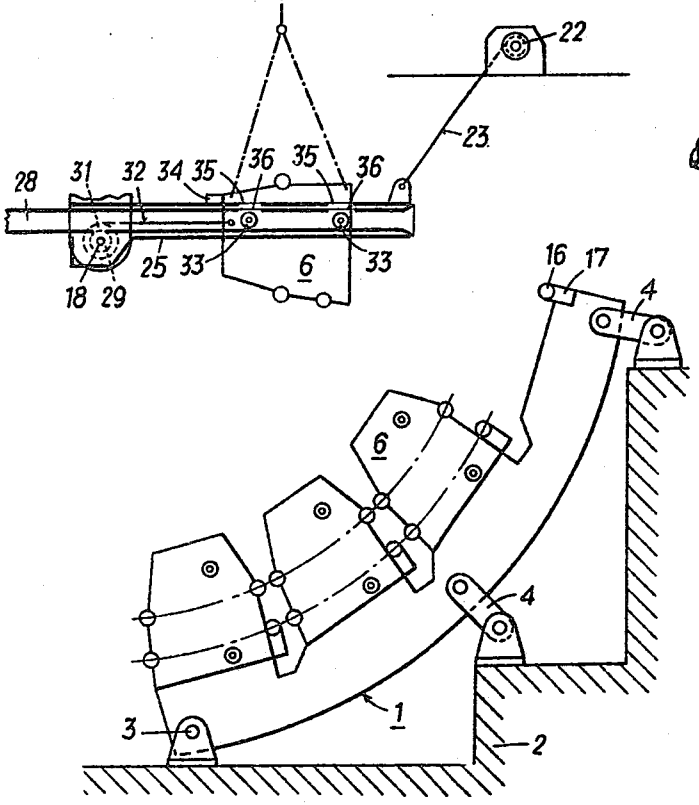

The arrangement functions in the following way:

At first, the pivoting lever is placed into position at the supporting segment 6 to be removed by means of the rope drive 22, while the retractable and extendable guide rails 28 are in the retracted position. At this segment 6, the roller 16, which is mounted on the carrier 17, is detached from the supporting segment 6 by detaching the carrier 17, and the carrier together with the roller is fastened in the recess 10 provided at the carrying frame 1. The guide rails 28 are displaced outwardly, the guide rails 28 thus coming into engagement with counter guides which are arranged on the sides of the supporting segments 6 and are designed as wheels 33. Then the rope 32 is fastened to the supporting segment (FIG. 1). As the next step, the supporting segment 6, as can be seen from FIG. 2, is drawn back by means of the rope 32 until it has reached the removal position represented in FIG. 2. The retraction movement of the segment 6 is delimited by a stop 34. Subsequently, the guide rails 28 are retracted until they have reached the retracted position illustrated in FIG. 3. In this position, openings 35 and 36 which are arranged on the upper side of the C-shaped profiles 25 and 28, respectively, come to lie one above the other. As a next step, the pivoting lever 19 is pivoted into a horizontal position, which is effected by means of the rope drive 22. After the rope 32 has been decoupled from the supporting segment 6 which is in the pivoting lever 19, the segment can be lifted out of the pivoting lever 19 by means of a crane, as is illustrated in FIG. 4, with wheels 33 passing through the aligned openings 35, 36.

What we claim is:

1. In a supporting and guiding stand arrangement to be used in a bow-type continuous casting plant and of the type including a carrying frame, a plurality of exchangeable supporting segments arranged along a circular arc and supported on said carrying frame, and strand guiding means with an outer guideway and an inner guideway arranged opposite each other and formed by rollers arranged at a distance from one another, which rollers are mounted in said supporting segments, a pivoting lever including means for seizing and extracting individual supporting segments mounted in the center of said circular arc, the length of said pivoting lever being shorter than the radial distance from the center to the supporting segments, the improvement which comprises telescopically extendable and retractable guide rails provided on said pivoting lever, means for moving said guide rails to and from a position adjacent said strand guiding means whereby said guide rails are disposed for engaging a supporting segment in a fork-like manner after having been extended and thus moved into the strand guiding means, counter guides being fastened on the supporting segment, said counter guides coming into engagement with said guide rails during their extension, said seizing and extracting means adapted to seize the respective supporting segment and move it along said guide rails from its installed position to its extracted position.

2. A supporting and guiding stand arrangement as set forth in claim 1, wherein said counter guides are designed as wheels.

3. A supporting and guiding stand arrangement as set forth in claim 1, wherein said counter guides are designed as rollers.

4. A supporting and guiding stand arrangement as set forth in claim 1, wherein said pivoting lever and said guide rails are designed with C-shaped profiles and, in the retracted position, openings are provided in said pivoting lever and in said guide rails for letting through said counter guides.

5. A supporting and guiding stand arrangement as set forth in claim 1, said seizing and extracting means comprising, in the center of said circular arc, a rope winch for drawing out the respective supporting segment and said guide rail moving means comprising an adjustment drive for extending and retracting said guide rails.

6. A supporting and guiding stand arrangement as set forth in claim 1, said guide rail moving means comprising a hydraulic drive moveable together with said pivoting lever and provided for extending and retracting said guide rails.

7. A supporting and guiding stand arrangement as set forth in claim 1, further comprising a carrier detachably fastened on each supporting segment and accommodating at least one rim-side roller of said outer guideway and wherein said carrier together with said at least one rim-side roller is placeable into a recess in said carrying frame during removal of the supporting segments.

* * * * *